United States Patent [19]

Dugrot

[11] Patent Number: 4,838,949

[45] Date of Patent: Jun. 13, 1989

[54] SHAVING RAZOR CLEANER

[76] Inventor: Felipe Dugrot, 5022 N.W. 168 Ter., Carol City, Fla. 33055

[21] Appl. No.: 171,754

[22] Filed: Mar. 22, 1988

Related U.S. Application Data

[63] Continuation-in-part of Ser. No. 52,502, Jul. 20, 1987, abandoned.

[51] Int. Cl.[4] ..... B08B 3/02

[52] U.S. Cl. ..... 134/32; 134/182; 134/166 R; 134/200

[58] Field of Search ..... 134/115, 166 R, 182, 134/183, 201, 200; 30/41, 123

[56] References Cited

U.S. PATENT DOCUMENTS

| | | | |
|---|---|---|---|
| 1,245,768 | 11/1917 | Randall | 134/198 UX |
| 3,009,468 | 11/1981 | Eberle | 134/166 R X |
| 3,212,158 | 10/1965 | Ranson | 134/183 X |
| 3,226,095 | 12/1965 | Ranson | 134/183 X |
| 3,730,809 | 5/1973 | Dietch | 134/182 X |
| 4,480,387 | 11/1984 | d'Alayer de Costemore d'Arc | 30/41 |

*Primary Examiner*—Harvey C. Hornsby

*Assistant Examiner*—Frankie L. Stinson

*Attorney, Agent, or Firm*—Malin, Haley & McHale

[57] ABSTRACT

A cleaner for a conventional single or double blade shaving razor using an accelerated stream of water fanned out by a deflector plate means for fanning and directing said accelerated stream of water uniformly across the blade edge area of the shaving razo head. The invention has an upper chamber adapted to fit in water-tight engagement with a conventional tap water faucet, the invention further comprising a lower or cleaning chamber fluidly communicating with said upper chamber by a constricting passageway wherethrough passes an accelerated stream of water. The accelerated stream of water is discharged into said cleaning chamber against said deflector plate, thereby fanning out and distributing uniformly and energetically against the blade area of the shaving razor head. An opening is provided in the front face of the body member of the instant invention wherethrough can be passed the razor head. Guiderails may be provided upon which the razor head can be slid underneath the fanned stream. Baffle material means may be provided for dissipating the energy of the fanned stream issuing from the deflector plate.

5 Claims, 3 Drawing Sheets

SHAVING RAZOR CLEANER

This is a continuation-in-part of U.S. application Ser. No. 052,502, filed July 20, 1987 entitled "POWER JET RAZOR CLEANER", and now abandoned.

BACKGROUND OF THE INVENTION

1. Field of the Invention

The present invention relates to a device designed to clean single and doubled edged razor blades, and more particularly relates to device to remove accumulated soap and shaving residue from between the blades of twin edge razor blade and between the blades and body of the razor blade cartridge itself by means of a powerful and turbulent stream of water taken from the nozzle of a common bathroom sink.

2. Prior Art

The need to keep the blade area clean of shaving razors, of both the single and double edged variety is well known. Maintaining the razor head clean both during and after shaving operates to extend the useful life of the razor head while simultaneously enhancing the performance thereof. The build up of residue which ordinarily occurs reduces the effectiveness of the blades and may even cause a dulling of the blade edges if left to remain thereon after use.

It has been proposed in the past to run the shaving head under ordinary tap water pressure, but this method is effective only to a very limited extent.

It is also common for shavers to tap the razor head on the inside surface of the sink during the shaving operation, but this method also is only marginally effective and is annoying.

It has also been proposed to place between the blades of a twin edge razor head a flexible plastic strip which can be operated by the user to push out particles which have accumulated between the two blades, but this solution is not satisfactory because the very presence of this strip of plastic prevents a rigid fastening of the twin razor blades within the head. This has the consequence that the blades, when so mounted, are more flexible; as a result, their effectiveness is reduced, the risk of cutting oneself is increased, and since, in addition, the cleaning is only partly effective, this solution has a very limited success. Moreover, a cleaning system of this kind increases the complexity of the assembly and its cost.

One attempt at addressing the problem can be found in U.S. Pat. No. 4,027,387 to Kellis, wherein is disclosed a 2-piece structure requiring the user to first place the razor into the lower unit (receptacle 11 thereof) and then cover said lower unit with an upper unit (element 12 thereof) then connect the entire device to a conventional household faucet while at the same time holding both halves of the device together with the fingers. Such a setup can be quite cumbersome and result in the use of excess time and a mess. Further, Kellis does not provide a uniform distribution of water over the razor head.

A further attempt at providing a device for cleaning razors is found in U.S. Pat. No. 4,480,387 to d'Alayer de Costemore d'Arc. No means are provided therein, however, for adjusting the angle of impact of the stream of water against the razor head and/or blades. It typically becomes necessary to allow the stream of water in devices such as these to impart force to the razor head and/or blades at a variety of angles to loosen all debri. Further, Baffles (9,10) of d'Alayer de Costemore d'Arc obstruct the water flow from making uniform contact across the razor head.

Also of interest are U.S. Pat. No. 4,228,586 to Thierry, U.S. Pat. No. 3,897,797 to Wright et al and U.S. Pat. No. 2,691,986 to Kirby.

SUMMARY OF THE INVENTION

The instant invention is a device designed to clean single and double edged razor blades by means of a powerful and turbulent stream of water taken from the nozzle of the ordinary bathroom sink. The flow of water is caused to pass through a constricted passage, thereby being accelerated, and is thereafter directed against a plate disposed at a certain angle and height with respect to the position of the razor to be cleaned. The accelerated stream of water directed against said plate causes said stream to fan out and contact the razor head uniformly, the angle of impact being dependent upon the orientation of the head as manipulated by the user controlling the razor handle. The stream of water issuing from the cleaned razor head impacts upon a baffle means to dissipate the energy thereof and avoid splashing of the user and surrounding area.

The device is comprised of an upper chamber adapted to receive a flow of tap water from a conventional household faucet. The upper peripheral rim of the upper chamber defines a circular opening sized and shaped to fit over the outside of the tip of said faucet in sealing engagement. Strap means are provided for retaining the device in sealing engagement with said faucet tip.

Said upper chamber communicates via a constricted passageway in nozzle-like fashion with a lower or cleaning chamber wherein a high velocity stream of water impacts against an angled deflector plate, said deflector plate causing the stream of water to fan out while still at high velocity, said fanned stream contacting and thereby cleaning the razor head positioned there below. Guide rail means may be provided below said deflector plate for the purpose of low friction sliding to and fro of the razor head so that the user can pass the razor under the fanned stream of water with little effort. Means are provided for dissipating the energy of the water issuing from the cleaning operation in the form of a baffle disposed below said guiderail means.

It is an object of the present invention to provide a one piece device which is connectable to a conventional household faucet to clean a common hand held shaver.

It is a further object of the present invention to provide a device for cleaning shaving razor blades quickly and neatly during the shaving operation.

It is a still further object of the present invention to provide a device for maintaining the cleanliness of a shaving razor to extend the useful life thereof.

It is a further object of the present invention to provide a device for cleaning a shaving razor head wherein a relatively high velocity stream of water is caused to fan out and be evenly distributed over the head of said shaving razor in order to clean same.

It is an even further object of the present invention to provide a baffle means for reducing the energy of the water issuing from the cleaning operation of a shaving razor to reduce splashing in a device using a conventional tap water outlet to clean a shaving razor head.

In accordance with this and other objects which will be apparent hereinafter, the instant invention will now be described with particular reference to the accompanying drawings.

DETAILED DESCRIPTION OF THE PREFERRED EMBODIMENT

Figure 1:
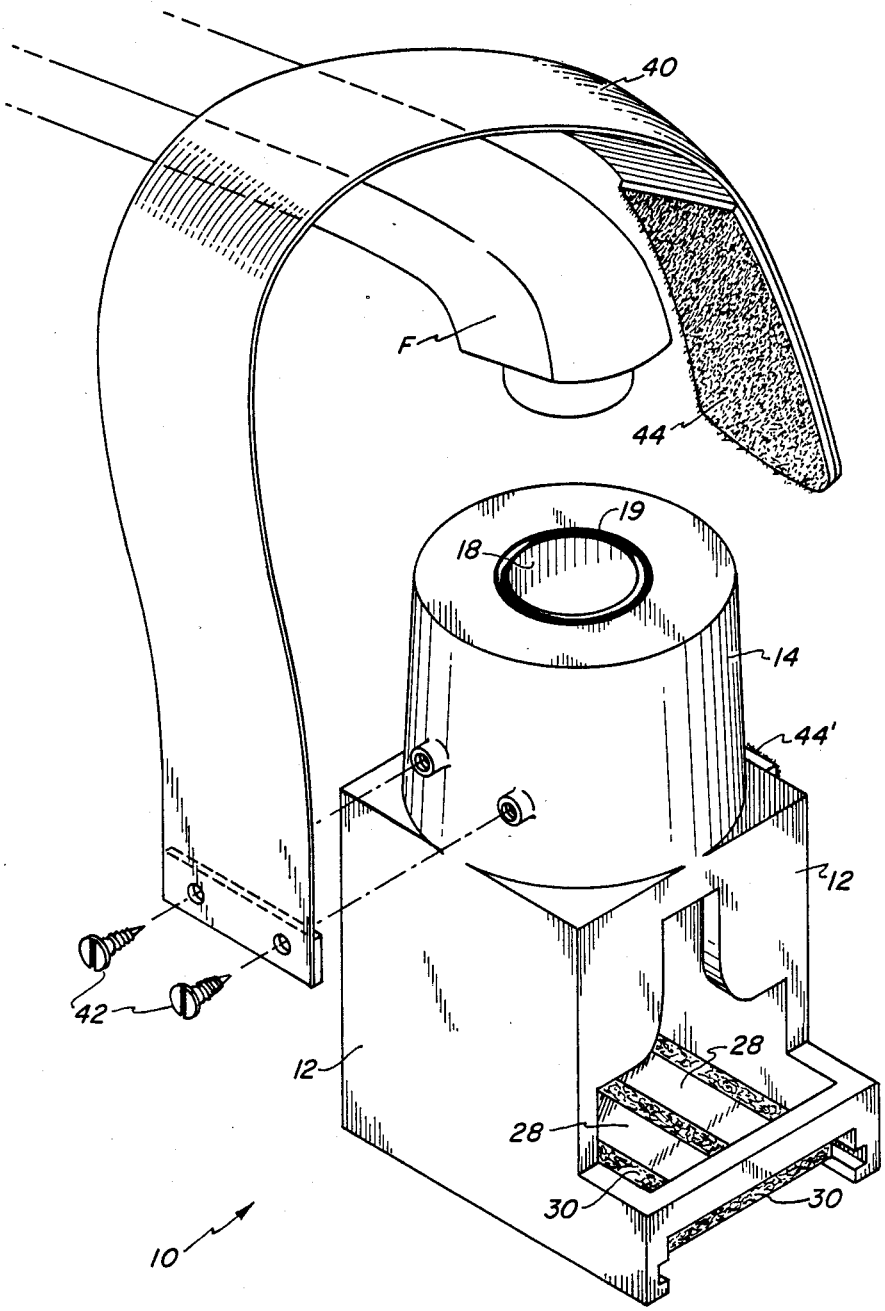
FIG. 1 is a perspective view of the invention showing same in position for attachment to a conventional household faucet.
Figure 2:
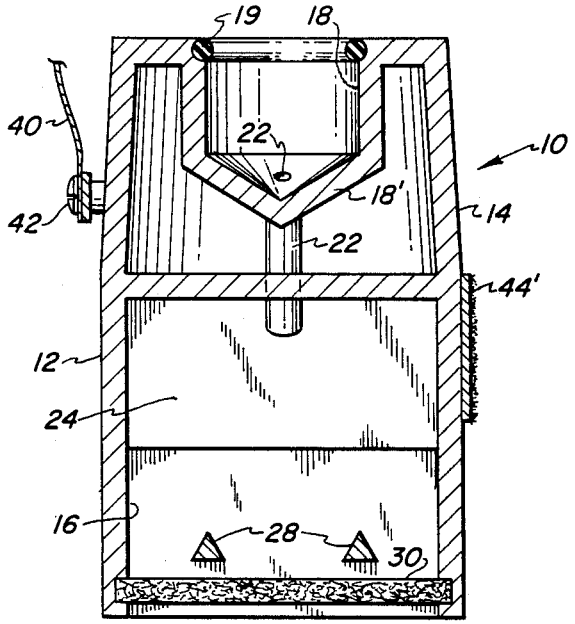
FIG. 2 is an elevational cut-away view taken along lines 2—2 of FIG. 1.
Figure 3:
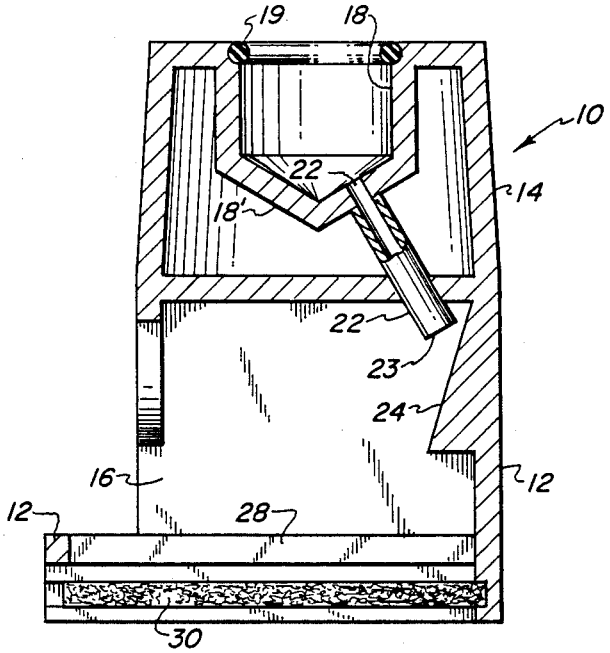
FIG. 3 is an elevational side cut-away view of the invention taken along lines 3—3 of FIG. 1.
Figure 7:
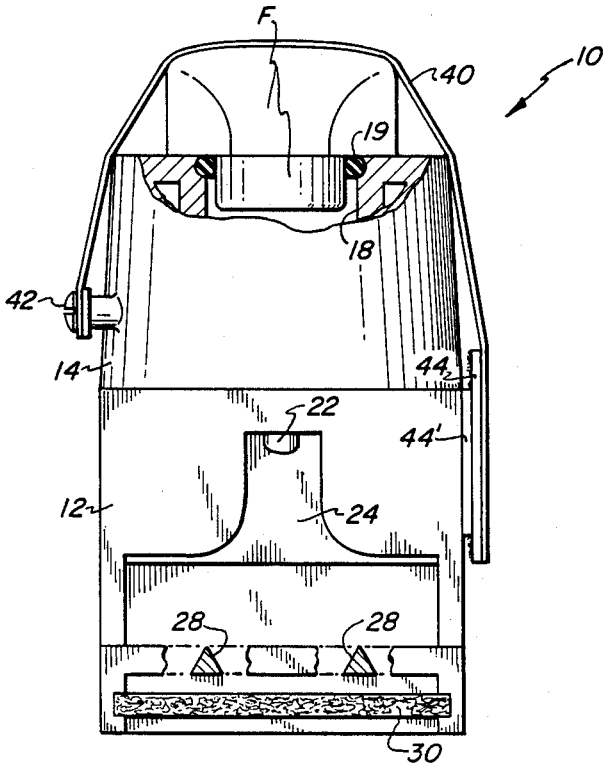
FIG. 7 is a front elevational view showing the invention connected to a conventional faucet.
Figure 6:
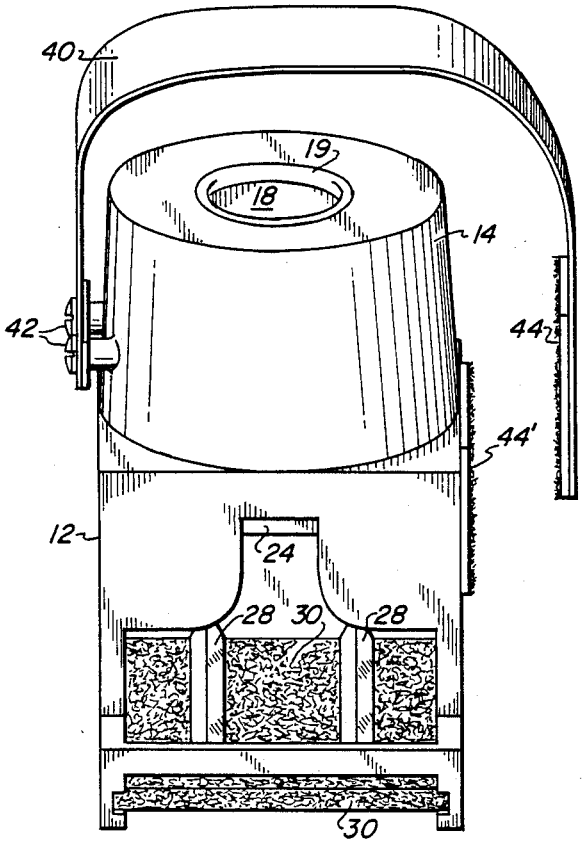
FIG. 6 is another perspective view of the invention.
Figure 4:
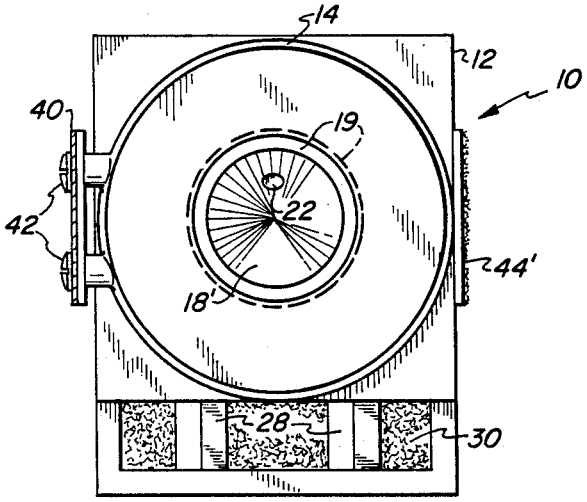
FIG. 4 is a plan view of the invention showing the water receiving chamber and discharge conduit opening therein, said discharge conduit opening being disposed closer to the rear of the device.
Figure 5:
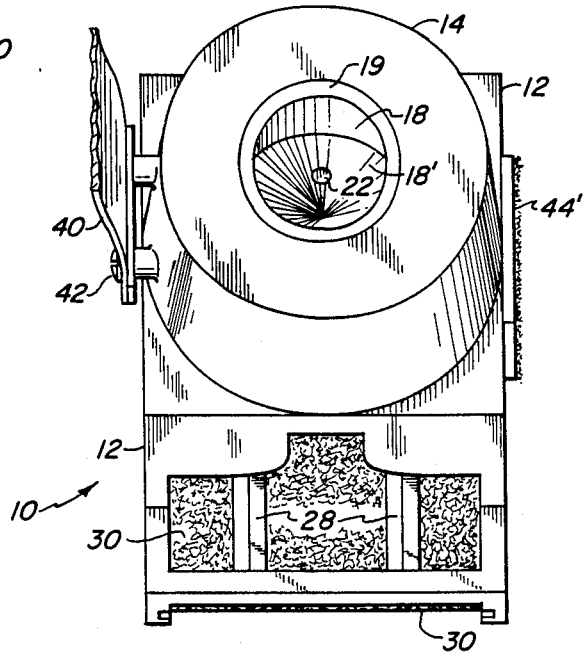
FIG. 5 is a perspective view of the invention.
Figure 8:
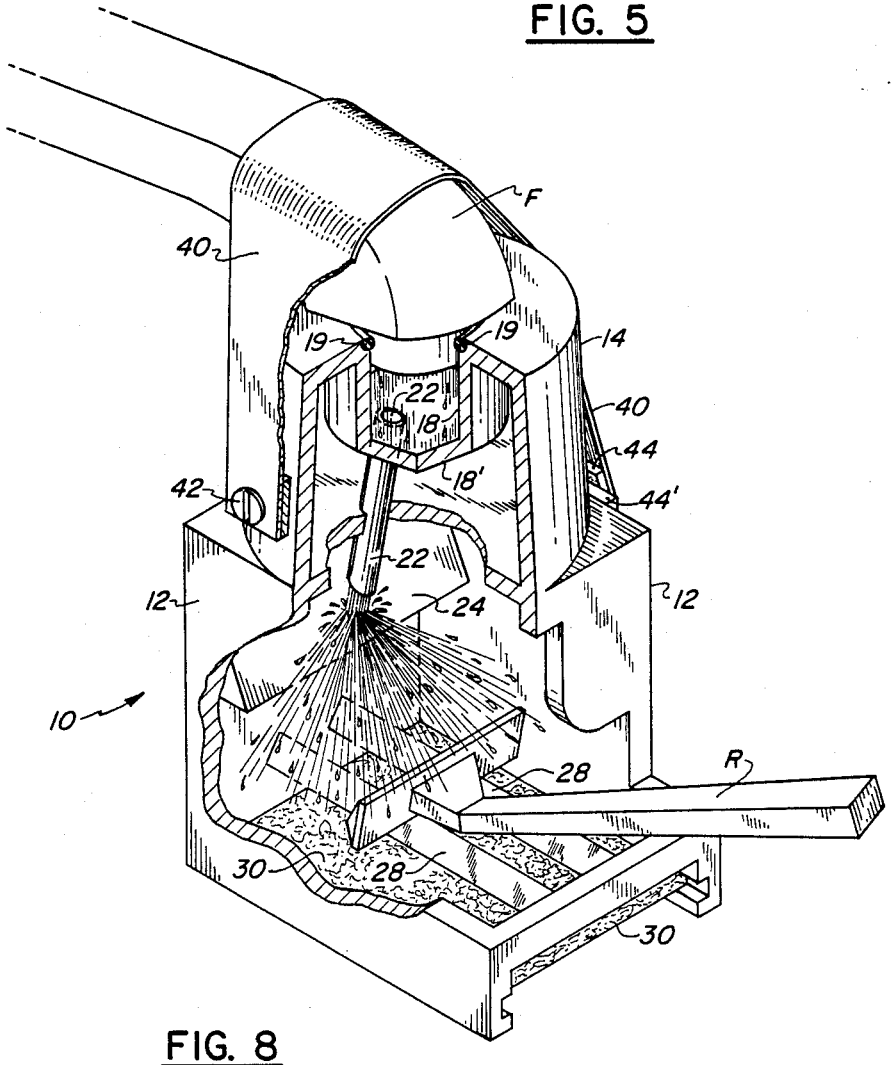
FIG. 8 is a partial cutaway perspective cutaway view showing detail of the upper chamber, water flow passage and deflector plate.

Referring now to the drawings, FIGS. 1–4 show the shaving razor cleaner 10 in detail comprised of a body section 12 having an upper body section 14 including a plenum chamber 18 adapted to receive a flow of tap water from an ordinary household tap F, the upper peripheral edge of said plenum 18 having attached thereto an O-ring 19 adapted to engage said tap in water tight engagement when the invention 10 is connected to said tap. Body member 12 has lower or cleaning chamber 16 comprised of, in the preferred embodiment, an inverted T-shaped opening in the front wall 12' of body 12 sized and shaped so that a conventional shaving razor head and handle R can be passed there through and slid forwardly and backwardly on guiderails 28 disposed in the lower portion of cleaning chamber 16. Front wall 12' of body 12 may, in the alternative, but not by way of limitation, define a regular or other shaped opening therein, so long as the head of the razor and a portion of the handle thereof may be passed into cleaning chamber 16.

Removable baffle material means 30 may be provided in the volume below guide rails 28. Said baffle material means are used to dissipate the energy of the discharged stream of water so as to prevent splashing onto the user and surrounding countertop, in a manner to be set forth below. Baffle means 30 may be removed for cleaning and for replacement.

Communicating water chamber 18 and cleaning chamber 16 is a relatively small diameter water-flow conduit 22. Said conduit 22 directs an accelerated flow of water from the tap through chamber 18 into a narrowing funnel-shaped volume 18' there below. Thereafter an opening 22' prime in said funnel-shaped volume 18' allows water to pass into conduit 22 and thereafter be discharged in the direction of a deflector plate 24 associated with the interior rear wall of cleaning chamber 16. The accelerated stream of water, upon impacting against said deflector plate 24, is caused to fan out due to the angled orientation of the impact surface of said deflector plate 24 relative to the direction of flow of the stream of water issuing from conduit 22.

In use, the invention 10 is preferably connected to the conventional tap water outlet by means of a quick disconnect strap 40 employing hook and loop fastener means 44 (female) and 44' (male). Strap 40 may be connected to body 12 at any desired location using fastening means 42, which may be self-threading screws. Once invention 10 is connected to said faucet, and O-ring 19 is providing a watertight seal therewith, the tap water may be commenced to flow. Water enters chamber 18 and is forced into conduit 22, and thereafter a relatively high velocity stream of water issues from discharge end 23 of conduit 22 and strikes deflector plate 24. Said flow of water fans out and impacts upon the head of the shaving razor which is being slid into the device along guiderails 28. The fanning effect created by deflector plate 24 causes the stream of water to spread out generally evenly across the contact area of the shaving razor head, thereby washing away unwanted residue therein.

It can be see, therefore, that the instant invention is a one piece unit connectable over the outer peripheral surface of a conventional tap water faucet. The stream of water issuing from conduit 22 is fanned out by deflector plate 24 thereby exposing the razor blade(s) to uniformly distributed pressurized tap water. The flow of water from the tap to the point of impact on the razor head is a non-obstructed flow, thereby increasing the efficiency of cleaning.

The guiderails 28 are preferrably triangularly shaped in cross section, with the triangle apex facing upwards to reduce the exposed contact area and therefore the effect of friction. The baffle material means 30 may be fiberglass or any other suitable material capable of uniformly dissipating the energy of a turbulent flow of water. After passing through said baffle material means 30, the water merely drips out aperatures (not shown) in the bottom surface of body member 12.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. A shaving razor cleaner, comprising:

a body member having an upper chamber and a lower chamber;

said upper chamber being sized and shaped for watertight engagement with a conventional tap water faucet;

said body member defining a passageway which fluidly communicates said upper chamber with said lower chamber, said passageway adapted to allow tap water to flow from said upper chamber into said lower chamber;

said passageway having a lower discharge end positioned relative to a deflector plate mounted in said lower chamber such that water issuing from said discharge end impacts upon said deflector plate;

said waterflow passageway being generally cylindrical and of a smaller cross sectional diameter than that of said upper chamber;

said deflector plate causing the flow of water issuing from said discharge end to fan out energetically into a volume therebelow within said cleaning chamber, said volume being sized and shaped to receive the shaving head portion of a conventional shaving razor;

further comprising guiderail means disposed generally horizontally along the lower surface of said body member, said guiderail means for guiding the head of a shaving razor so that said head of said shaving razor can be passed under the fanned out stream of water issuing from said deflector plate in reciprocal motion.

2. The shaving razor cleaner of claim 1, further comprising baffle material means for dissipating the energy in the fanned out stream of water issuing from said deflector plate.

3. The shaving razor cleaner of claim 2, further comprising means for removably attaching said upper chamber in watertight engagement around the outer peripheral surface of the end of a conventional tap water faucet.

4. The shaving razor cleaner of claim 1, wherein said means for removably attaching is a strap which connects said upper chamber to said faucet by passing from connection to one side of said body member over the top of said faucet and connecting to the other side of said body member by quick release means.

5. A method for cleaning a shaving razor comprising the steps of:

connecting a shaving razor cleaner to a conventional tap water faucet, said shaving razor cleaner comprising:

a body member having an upper chamber and a lower chamber;

said upper chamber being sized and shaped for watertight engagement with a conventional tap water faucet;

said body member defining a passageway which fluidly communicates said upper chamber with said lower chamber, said passageway adapted to allow tap water to flow from said upper chamber into said lower chamber;

said passageway having a lower discharge end positioned relative to a deflector plate mounted in said lower chamber such that water issuing from said discharge end impacts upon said deflector plate;

said waterflow passageway being generally cylindrical and of a smaller cross sectional diameter than that of said upper chamber;

said deflector plate causing the flow of water issuing from said discharge end to fan out energetically into a volume therebelow within said cleaning chamber, said volume being sized and shaped to receive the shaving head portion of a conventional shaving razor;

further comprising guiderail means disposed generally horizontally along the lower surface of said body member, said guiderail means for guiding the head of a shaving razor so that said head of said shaving razor can be passed under the fanned out stream of water issuing from said deflector plate in reciprocal motion;

causing water to issue through said faucet by turning on a flow of water therefrom to thereby cause a high energy flow of water to issue from said waterflow passageway and deflect off of said deflector plate;

passing the shaving head portion of said conventional shaving razor into and out of exposure to said fanned out stream of water issuing from said deflector plate in reciprocal motion, while sliding said shaving head portion along said guiderail means.

* * * * *